United States Patent [19]

Bloom et al.

[11] 4,128,098

[45] Dec. 5, 1978

[54] VALVED SPIKE TRANSFER DEVICE

[75] Inventors: William G. Bloom, Los Angeles; Pradip V. Choksi, Northridge; Walter Seemayer, Burbank, all of Calif.

[73] Assignee: American Hospital Supply Corporation, Evanston, Ill.

[21] Appl. No.: 747,416

[22] Filed: Dec. 6, 1976

[51] Int. Cl.[2] ..... A61J 1/00

[52] U.S. Cl. ..... 128/272.3; 141/27

[58] Field of Search ..... 128/272.3, 272, 221, 128/DIG. 26, 214.2, 218 NV, 218 PA; 141/27

[56] References Cited

U.S. PATENT DOCUMENTS

| | | | |
|---|---|---|---|
| 1,324,206 | 12/1919 | Nickell | 76/4 |
| 2,746,455 | 5/1956 | Abel | 128/221 |
| 2,771,074 | 11/1956 | Landsperger et al. | 128/276 |
| 2,818,864 | 1/1958 | Hudson | 128/272 |
| 2,953,132 | 9/1960 | Richter et al. | 128/272 |
| 3,098,481 | 7/1963 | Wikander et al. | 128/215 |
| 3,385,301 | 5/1968 | Harautuneian | 128/349 |
| 3,542,240 | 11/1970 | Solowey | 222/83 |
| 3,570,484 | 3/1971 | Steer | 128/221 X |
| 3,592,245 | 7/1971 | Schneller | 128/272 X |
| 3,608,550 | 9/1971 | Stawski | 128/272 |
| 3,826,261 | 7/1974 | Killinger | 128/272 |
| 3,853,157 | 12/1974 | Madaio | 141/2 |
| 3,940,003 | 2/1976 | Larson | 128/272 X |

FOREIGN PATENT DOCUMENTS

| | | | |
|---|---|---|---|
| 1227395 | 8/1960 | France | 128/272 |

*Primary Examiner*—Robert W. Michell
*Assistant Examiner*—Michael H. Thaler
*Attorney, Agent, or Firm*—Larry N. Barger

[57] ABSTRACT

A transfer device for charging a series of hypodermic syringes with medicament from a vial, such as in hospital pharmacies. The transfer device includes a valved spike with a syringe coupler rigidly supported on the spike. Contained within the syringe coupler is a longitudinally collapsible valve that opens upon insertion of a blunt syringe tip into the coupler and closes upon removal of such syringe tip. A protective skirt on the coupler has snap lugs for securing the transfer device to the vial.

18 Claims, 8 Drawing Figures

VALVED SPIKE TRANSFER DEVICE

BACKGROUND OF THE INVENTION

In hospitals containing many patients, it is common practice to preload the hypodermic syringes in the hospital pharmacy and then transfer them to the particular floors for injection into patients.

Many medicaments are supplied to the pharmacies in vials with puncturable rubber stoppers sealing an outlet of the vial. It has been common practice to attach a hypodermic needle to each syringe to be filled. Sometimes the floor nurse giving the injection required a different size needle to inject into a patient than the pharmacist used to fill the syringe, which filling needle was sent along with the syringe to the floor nurse. In these situations, two needles were needed for a single patient injection.

When a common vial was used to fill many syringes, this required multiple punctures of the rubber stopper. This could cause mechanical deterioration of the stopper material and permit tiny bits of the rubber stopper to be drawn into the syringe. Despite this disadvantage, hypodermic needles with thin tubular metal cannulae are continually being used to repeatedly puncture the vial's rubber stopper. These cannulae are used for such repeated punctures because the stopper tends to reclose the puncture passage upon withdrawal of a particular cannula, thus performing a valving function.

SUMMARY OF THE INVENTION

This invention provides an improved vial transfer device which requires only a single puncture of the vial's rubber stopper. A series of hypodermic syringes can be filled from a single vial with the valved spike transfer device of this invention.

This invention includes a transfer device with a rigid tubular spike and a syringe coupler rigidly supported on this spike. Within the coupler is a special valve member that opens upon insertion of a blunt syringe tip into the coupler and closes upon removal of such syringe tip. To physically secure the transfer device to the vial, a protective skirt with snap lugs engages a neck flange of the vial.

DETAILED DESCRIPTION

Figure 1:
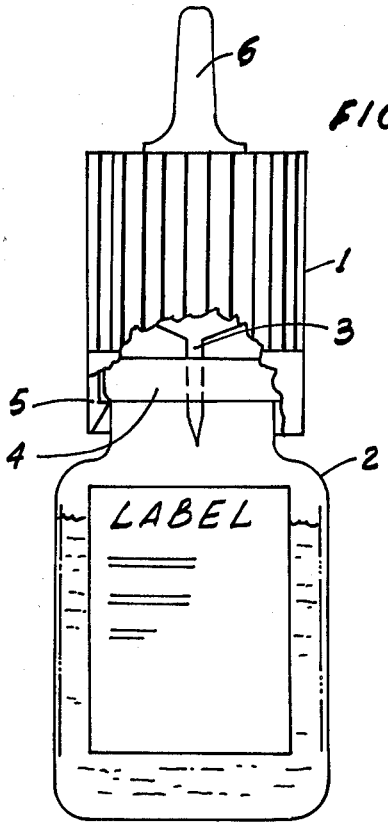
FIG. 1 is a front elevational view of a medicament vial with the valved spike transfer device partially broken away, attached to this vial.

In FIG. 1 the valved spike transfer device, designated generally as 1, is attached to a medicament vial 2. The transfer device has a spike 3 that punctures a rubber stopper in the neck of vial 2. As shown by the broken away section in FIG. 1, the transfer device is removably attached to a neck flange 4 of the vial by one or more spring lugs designated as 5. At an upper end of the transfer device is a removable protector 6.

Figure 2:
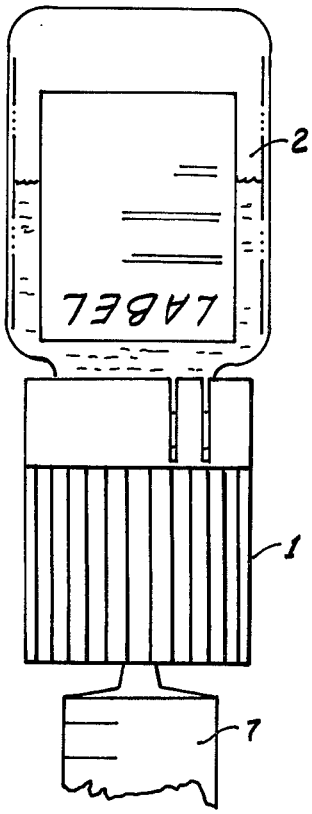
FIG. 2 is a front elevational view of the vial in inverted position after the protector has been removed and a syringe connected to the transfer device.

When the assembled vial and transfer device are ready for use, the protector 6 is removed and a syringe 7 is attached to the transfer device. So that the liquid will drain into the syringe as its plunger (not shown) is withdrawn, the vial is usually inverted, as shown in FIG. 2. The internal details of the valved spike transfer device and how the protector 6 and syringe 7 attaches thereto will be discussed in more detail with reference to FIGS. 5-8.

Figure 3:
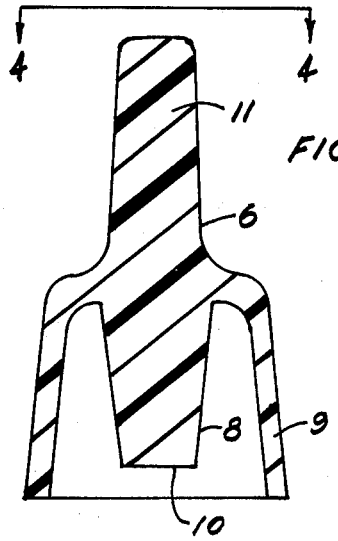
FIG. 3 is an enlarged sectional view of the protector for the transfer device.
Figure 4:
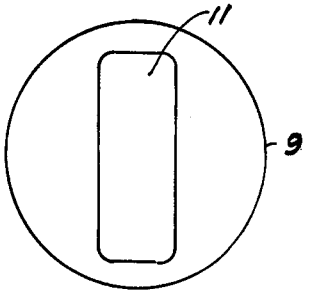
FIG. 4 is a top plan view taken along line 4—4 of the protector in FIG. 3.

In FIG. 3 the removable protector 6 is shown in enlarged cross-sectional detail. Here the protector has an externally luer tapered wedge plug 8 for insertion into a tubular syringe tip receiver of the valved spike transfer device. Spaced radially from the wedge plug section 8 is a protective skirt 9. This skirt 9 also extends forwardly beyond an end 10 of wedge plug 8 providing a protection against inadvertent contamination of this end 10. For convenient manipulation, a handle 11 is provided on the protector. FIG. 4 shows the flattened shape of handle 11.

Figure 5:
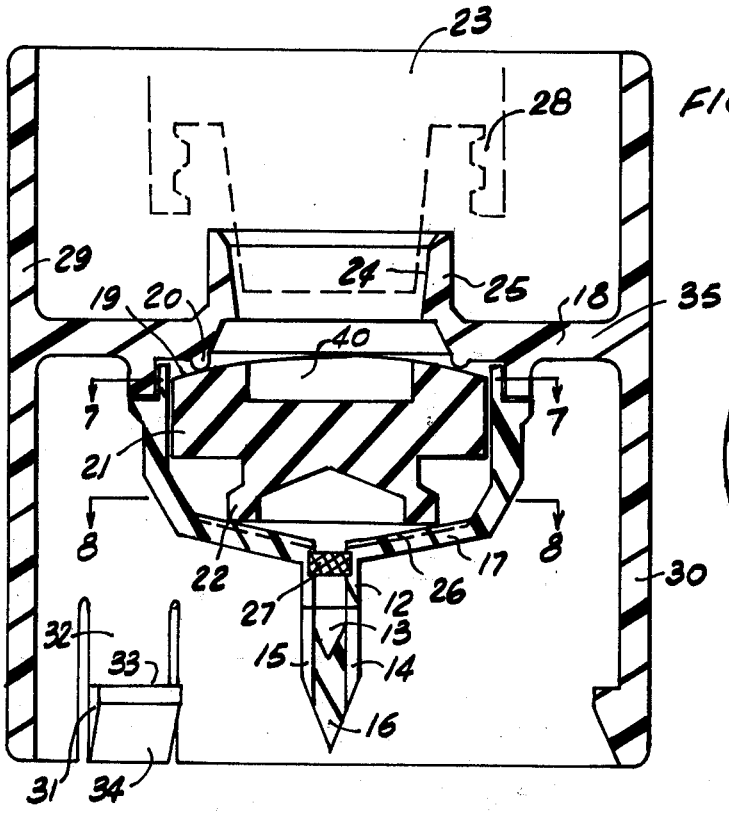
FIG. 5 is an enlarged sectional view of the valved spike transfer device.

The cross-sectional view of FIG. 5 shows the internal details of the valved spike transfer device. Here a rigid tubular spike 12 is provided with a passage 13 which communicates with side ports 14 and 15 adjacent a sharpened closed forward end section 16 of the spike. This construction has an advantage over beveled metal hypodermic needles in reducing rubber particulate matter formed during puncture, sometimes called "coring." The spike 12 could be either non-vented (as shown) or be vented (not shown) with a groove or passage to inlet air into the vial as liquid is withdrawn. With a non-vented spike, the pharmacist injects air into the vial with an attached syringe to relieve any vacuum in the vial prior to withdrawing liquid into the syringe.

The rigid tubular spike 12 is connected to a valve member housing 17 of the syringe coupler. This housing 17 is in turn sealed to a transverse wall 18 of the coupler to form a confinement chamber for a longitudinaly collapsible rubber valve member 19. The transverse wall 18 also includes an annular sealing rib 20 within this chamber.

The collapsible valve member 19 includes a sealing head 21 integrally formed with a collapsible skirt 22 that urges the sealing head 21 into engagement with sealing rib 20.

The valved spike transfer device is connected to a blunt luer tapered adapter 23, shown in dotted line, which wedgingly seals against an internal luer taper surface 24 of tubular syringe tip receiver 25. As the blunt tapered syringe tip shown in FIG. 5 continues its downward movement, it engages sealing head 21 of the valve member 19 causing skirt 22 to further collapse and temporarily remove sealing head 21 from its engagement with sealing rib 20. Because of a grooved structure 26 against which the skirt 22 presses, liquid from the vial can flow through passage 13 of the rigid tubular spike, through grooves 26, around the valve member and into the syringe. To prevent any rubber particles or other particulate matter from entering the syringe from the vial, an optional filter 27 can be provided in the passage 13 of rigid tubular spike 12.

As the blunt syringe tip 23 is longitudinally removed from tubular syringe tip receiver 25, the valve member sealing head 19 seals against annular rib 20. Preferably the tubular syringe tip receiver 25 has a wall sufficiently thin to avoid engagement with an internally threaded skirt 28 which some syringes have. If desired, tubular syringe tip receiver 25 could include external threads for engaging a skirt 28 of a syringe. Since this would require an additional manual screwing motion for assembling and disassembling the syringe from the valved spike transfer device, such structure has not been shown in the preferred embodiment of FIG. 5.

Integrally connected to the transverse wall 18 is a rear skirt 29 which extends rearwardly beyond an entrance to tubular syringe tip receiver 25, thereby protecting it from inadvertent contamination. Also integrally connected with transverse wall 18 is a forward skirt 30, which extends forwardly beyond the forward puncture point 16 of tubular spike 12. Thus spike point 16 is protected from inadvertent contamination, such as when the valved spike transfer device is resting on a table top.

Integrally formed with the forward skirt is a lug 31 with a spring biased section 32, a flat shoulder section 33, and a tapered lead-in section 34. This lug construction can readily snap onto a vial neck flange to retain the valved spike transfer device connected to the vial. If desired to remove the transfer device from the vial, a very firm pull can accomplish this.

Figure 6:
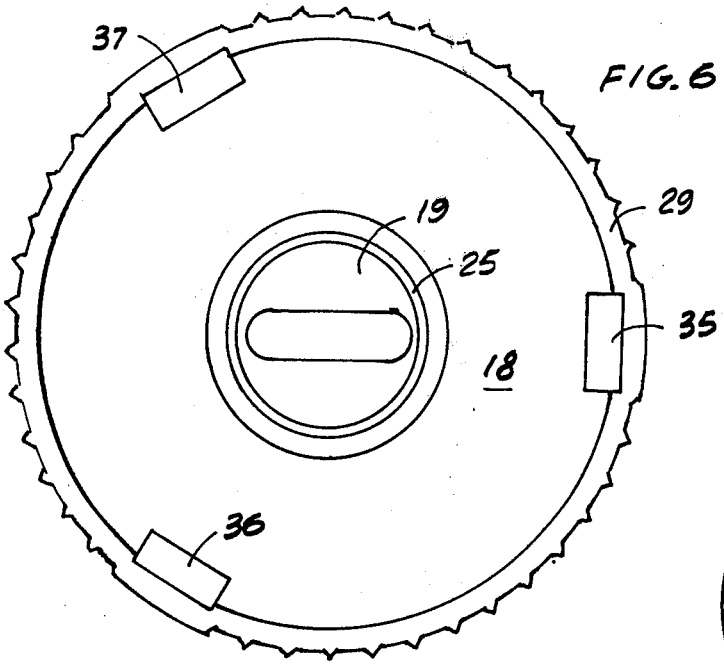
FIG. 6 is a top plan view of the valved spike transfer device.
Figure 7:
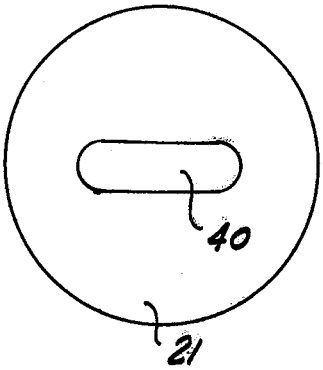
FIG. 7 is a sectional view taken along line 7—7 of FIG. 5.

In the top plan view of FIG. 6, the relationship of the upper skirt 29, transverse wall 18, tubular syringe tip receiver 25, and valve member sealing head 19 are shown. A series of openings 35, 36, and 37 in transverse wall 18 aid in the molding procedure for forming three lugs integral with lower skirt 30.

Figure 8:
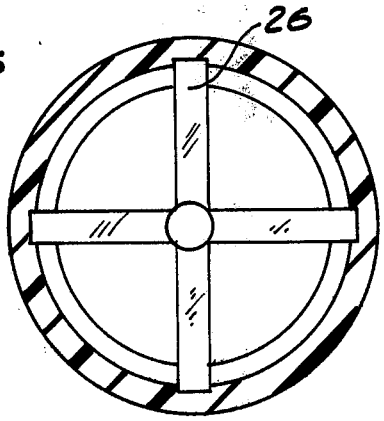
FIG. 8 is a sectional view taken along line 8—8 of FIG. 5.

The view taken along line 7—7 of FIG. 5 illustrates the top profile of the valve member 19 with a groove 40. This groove 40 prevents the valve member's sealing head 21 from occluding a passage through a syringe's blunt tapered tip. FIG. 8 shows the grooves 26 in valve member housing 17 to prevent the collapsible skirt from blocking fluid passage through the valved spike transfer device.

The valved spike transfer device works very well when the spike and syringe coupler are made of polycarbonate, and the collapsible valve is made of a rubber, such as silicone rubber.

In the foregoing description we have used a specific embodiment to describe the invention. However, it is understood by those skilled in the art that modifications can be made to this embodiment without departing from the spirit and scope of the invention.

We claim:

1. A valved spike transfer device comprising: a forwardly extending rigid tubular spike; a syringe coupler rigidly connected to the spike, said syringe coupler including a valve structure that has a tubular rearwardly projecting syringe tip receiver and a movable sealing means that opens upon insertion of a blunt syringe tip into the syringe tip receiver and closes upon removal of such syringe tip; a protector skirt projecting rearwardly beyond the tubular syringe tip receiver and spaced radially outward therefrom to define an annular recess of a size to receive a conventional threaded collar surrounding a tapered syringe tip, said tubular syringe tip receiver having a wall sufficiently thin to be received between such conventional tapered adapter and surrounding threaded collar; and a vial coupling means permanently joined at a fixed location to a unit formed by the syringe coupler and spike.

2. A valved spike transfer device as set forth in claim 1, wherein the vial coupling means includes a forward skirt radially spaced from the spike.

3. A valved spike transfer device as set forth in claim 2, wherein the spike has a forward puncture point and the forward skirt extends longitudinally beyond the puncture point of the spike to protect it from contamination.

4. A valved spike transfer device as set forth in claim 2, wherein the forward skirt has the vial coupling means for securing the coupler to a medicament vial.

5. A valved spike transfer device as set forth in claim 4, wherein the retention means has at least one spring biased lug.

6. A valved spike transfer device as set forth in claim 5, wherein the forward skirt and spring biased lug are of the same thermoplastic material and are an integral one-piece unit.

7. A valved spike transfer device as set forth in claim 1, wherein the tubular spike has a pointed closed forward end with one or more side openings adjacent this forward end for fluid flow.

8. A valved spike transfer device as set forth in claim 1, wherein the coupler has a tubular syringe tip receiver with an internally tapered surface to wedgingly form a seal with a tapered tip of a syringe.

9. A valved spike transfer device as set forth in claim 1, wherein the coupler has a valve member with a resilient section that is longitudinally collapsible upon contact with a blunt syringe tip.

10. A valved spike transfer device as set forth in claim 9, wherein the valve member has a longitudinally collapsible skirt and a grooved sealing head.

11. A valved spike transfer device as set forth in claim 1, wherein the coupler has a rear skirt based radially from an entrance to said valve.

12. A valved spike transfer device as set forth in claim 11, wherein the coupler has a syringe tip coupling passage and the skirt extends longitudinally beyond a rear entrance to such passage.

13. A valved spike transfer device as set forth in claim 1, wherein the syringe coupler has a removable protector.

14. A valved spike transfer device as set forth in claim 13, wherein the protector includes a tapered wedge plug surrounded by a radially spaced skirt which extends longitudinally beyond an end of the wedge plug, and the syringe coupler includes an internally tapered passage leading to its valve structure which wedgingly receives the protector's wedge plug.

15. A valved spike transfer device as set forth in claim 1, wherein the set has a filter in an internal fluid path.

16. A valved spike transfer device as set forth in claim 15, wherein the filter is in a passage of the rigid tubular spike.

17. A valved spike transfer device comprising: a forwardly extending rigid tubular spike; and a nozzle coupler rigidly connected to the spike, said nozzle coupler including a valve that has a tubular rearwardly projecting nozzle receiver and a movable sealing means that opens upon insertion of a blunt tubular nozzle into the coupler and closes upon removal of such nozzle from the coupler; a protector skirt projecting rearwardly beyond the tubular nozzle receiver and spaced radially outward therefrom to define an annular recess of a size to receive a collar approximately the size of a conventional threaded syringe collar, which collar surrounds the nozzle, said tubular nozzle receiver having a wall sufficiently thin to be received between such nozzle and surrounding skirt; and a vial coupling means permanently joined at a fixed location to a unit formed by the nozzle coupler and spike.

18. A system for transferring dosages of liquid comprising: a reservoir medicament vial with a fluid therein; a valved spike transfer device including a forwardly extending rigid tubular spike with means sealingly connected to such vial, and a nozzle coupler rigidly connected to the spike, said nozzle coupler including a valve structure that has a tubular rearwardly projecting nozzle receiver and a movable sealing member that opens upon insertion of a blunt tubular nozzle into the coupler and closes upon removal of such nozzle; a protector skirt projecting rearwardly beyond the tubular nozzle receiver and spaced radially outward therefrom to define an annular recess of a size to receive a collar approximately the size of a conventional threaded syringe collar, which collar surrounds the nozzle, said tubular nozzle receiver having a wall sufficiently thin to be received between such nozzle and surrounding skirt; and a vial coupling means permanently joined at a fixed location to a unit formed by the nozzle coupler and spike.

* * * * *